United States Patent [19]

Vigneri

[11] 4,047,363

[45] Sept. 13, 1977

[54] PACKAGING APPARATUS

[75] Inventor: Alfonso Vigneri, Batavia, N.Y.

[73] Assignee: Richard Rath Packaging Machinery, Inc., Fairport, N.Y.

[21] Appl. No.: 739,384

[22] Filed: Nov. 5, 1976

[51] Int. Cl.[2] ..... B65B 7/06; B65B 7/18

[52] U.S. Cl. ..... 53/371

[58] Field of Search ..... 53/371, 373, 139

[56] References Cited

U.S. PATENT DOCUMENTS

| | | | |
|---|---|---|---|
| 1,931,280 | 10/1933 | Allison | 53/371 X |
| 1,973,696 | 9/1934 | Allison et al. | 53/371 X |
| 2,637,153 | 5/1953 | Clary | 53/371 X |
| 2,662,357 | 12/1953 | Stone | 53/371 |
| 3,559,372 | 2/1971 | Cerioni | 53/371 X |
| 3,691,968 | 9/1972 | Schnepf | 53/139 X |

*Primary Examiner*—Othell M. Simpson
*Assistant Examiner*—Horace M. Culver
*Attorney, Agent, or Firm*—Martin LuKacher

[57] ABSTRACT

The open mouth of a container such as a bag or sack which is filled with produce or other goods is folded by means of a single oscillatory finger which forms a fold in the leading and trailing sides of the bag as it travels along a path, as by being carried on a conveyor. The finger is oscillated by means of a mechanism driven by the bag which causes the finger to execute a forward stroke of oscillation whereby to form the fold in the leading side of the bag and then to form the fold in the trailing side of the bag as the finger executes its return stroke. The mechanism provides, as by means of a cam which oscillates with the finger, the timing of the forward and return strokes in coordination with the movement of the bag such that the bag may move continuously during the form folding operation. The fold is maintained by applying lateral pressure on opposite sides of the fold, as by means of opposed belts which engage the bag as the bag leaves the vicinity of the finger. The closed bag may be fed to a sealing machine, such as a stitcher, for permanently sealing the bag.

10 Claims, 6 Drawing Figures

PACKAGING APPARATUS

The present invention relates to packaging apparatus and particularly to apparatus for forming folds in, and closing, containers.

The invention is especially suitable for use in automatically closing the open mouth of bags or sacks after they have been filled with produce, such as potatos, or other goods. The closed bag may be fed to a stitching machine or other sealing machine.

Packaging machinery has been devised for the purpose of automatically folding and closing containers. These machines, however, are characterized by the need for electrical or fluid powered controls. They are also complex which makes its maintenance difficult and reduces reliability. For further information with respect to such automatic container closing machinery, reference may be had to the following United States patents: U.S. Pat. Nos. 1,851,676; 2,410,834; 2,712,210; 2,783,600; 2,909,875; 3,213,591; and 3,520,103.

Many products are packaged in containers of different size. For example, potatos may be packaged in five pound, ten pound and 25 pound sacks for retail sale. It is a feature of this invention that sacks of various size can readily be accommodated and the open ends of such bags of various sizes may be folded and closed in the operation of a machine embodying the invention.

Accordingly, it is an object of this invention to provide improved packaging apparatus which is especially adapted for forming folds in and folding the open ends of open mouthed containers such that they can be closed.

It is another object of the present invention to provide improved automatic packaging equipment for closing successive containers as they move continuously along a path of travel, as by being carried by conveying means.

It is a further object of the present invention to provide improved packaging apparatus for closing bags, sacks, packages, and other containers automatically, which may be readily implemented in the form of a machine which is reliable in operation and which may readily be maintained.

It is a still further object of the invention to provide improved apparatus for closing the open ends of bags, packages and other containers which have been filled with produce or the like goods, which apparatus is less complicated in design and which may have a lower cost of fabrication than machines for similar purposes which have heretofore been available.

Briefly described, apparatus embodying the invention is adapted for use in closing the open ends of containers, such as sacks, bags and other packages, while they move along a path of travel. The containers may be spaced successively along this path. When so spaced, trailing and leading sides of successive containers have a space therebetween. The apparatus includes a finger which is disposed adjacent to the path of travel, preferably above the path. The finger is rotatably mounted, as on a shaft which is transverse to the path of travel, so that the finger is capable of oscillation along an arc. The arc extends from a location between the trailing and leading sides of the successive containers (viz., in the space between the containers) and a second location which is spaced from an open end of the containers. This second location may be above the open end of the containers. Means are provided for driving the finger so as to execute forward and return strokes as it oscillates along this arc. During the forward stroke the finger forms a fold in the leading side of a bag and during the return stroke the finger forms a fold in the trailing side of the bag. These folds may be in gussets which are provided in the bag. The folded open end of the bags may be pressed together to close the bag, as by means of belts which are spaced from the finger in the direction of travel of the bag and which receive the folded end of the bags therebetween. The bags are closed and may be sealed in closed condition as by a stitcher machine or other conventional sealing means.

It is a feature of this invention that no special controls or motors need be provided for oscillating the finger. Instead the bags themselves operate a mechanism, as may include a cam which is attached to and rotatable with the shaft to which the finger is also attached. The cam is actuated so as to oscillate the finger in timed relationship with the movement of the bags past the finger. The forward and leading sides of the bags are in the position where they are intersected by the arc described by the finger when the finger is driven toward the bags so as to form the folds therein.

In order to accommodate bags of various sizes the finger need only be raised vertically and moved laterally. Such adjustment in the location of the finger may rapidly be accomplished, as by raising or lowering the conveyor which carries the bags.

The foregoing and other objects, features and advantages of the invention may more readily be understood from the following description of the presently preferred embodiment thereof with reference to the accompanying drawings in which.

Figure 1:
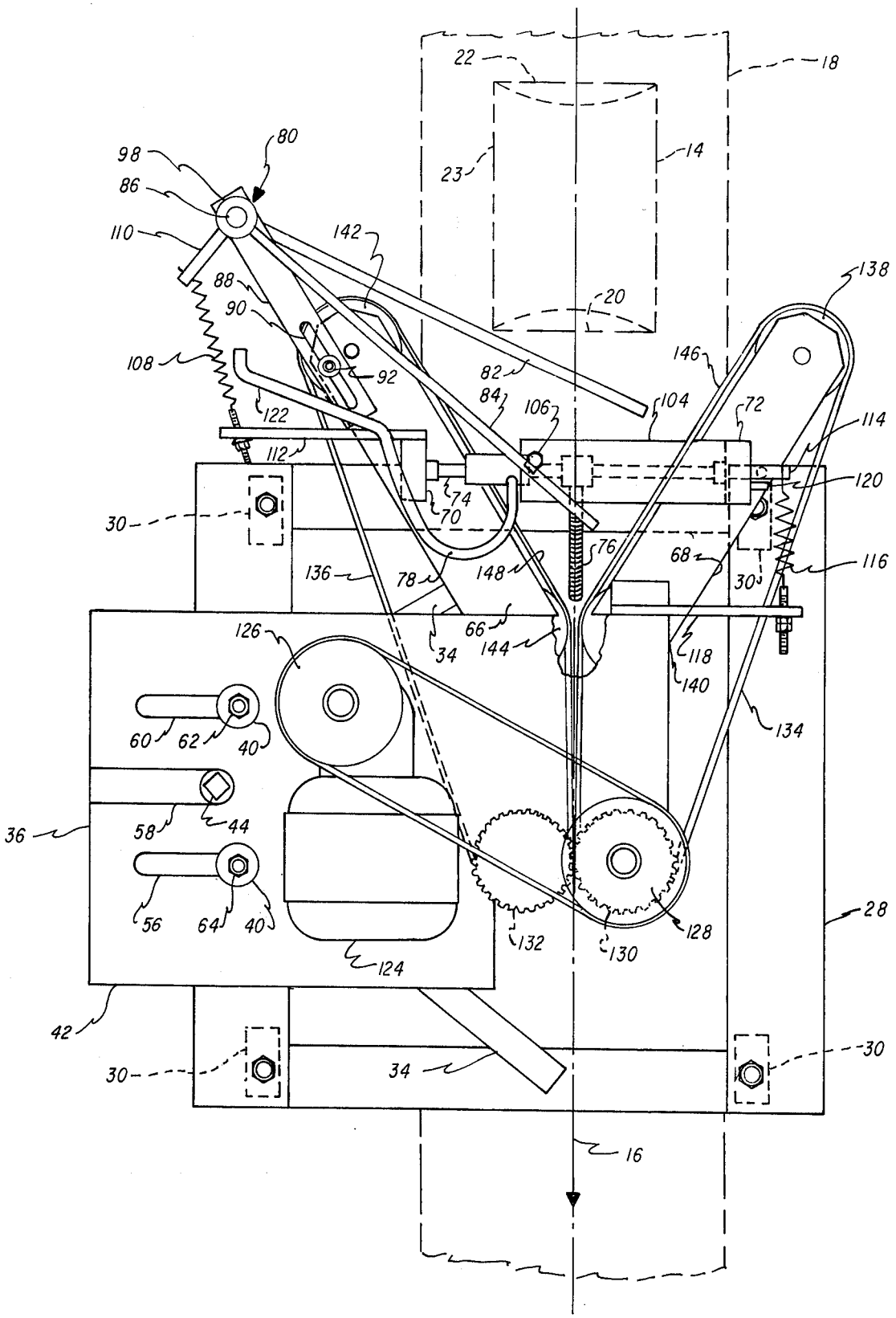
FIG. 1, is a top view of a bag closing machine embodying the invention.
Figure 2:
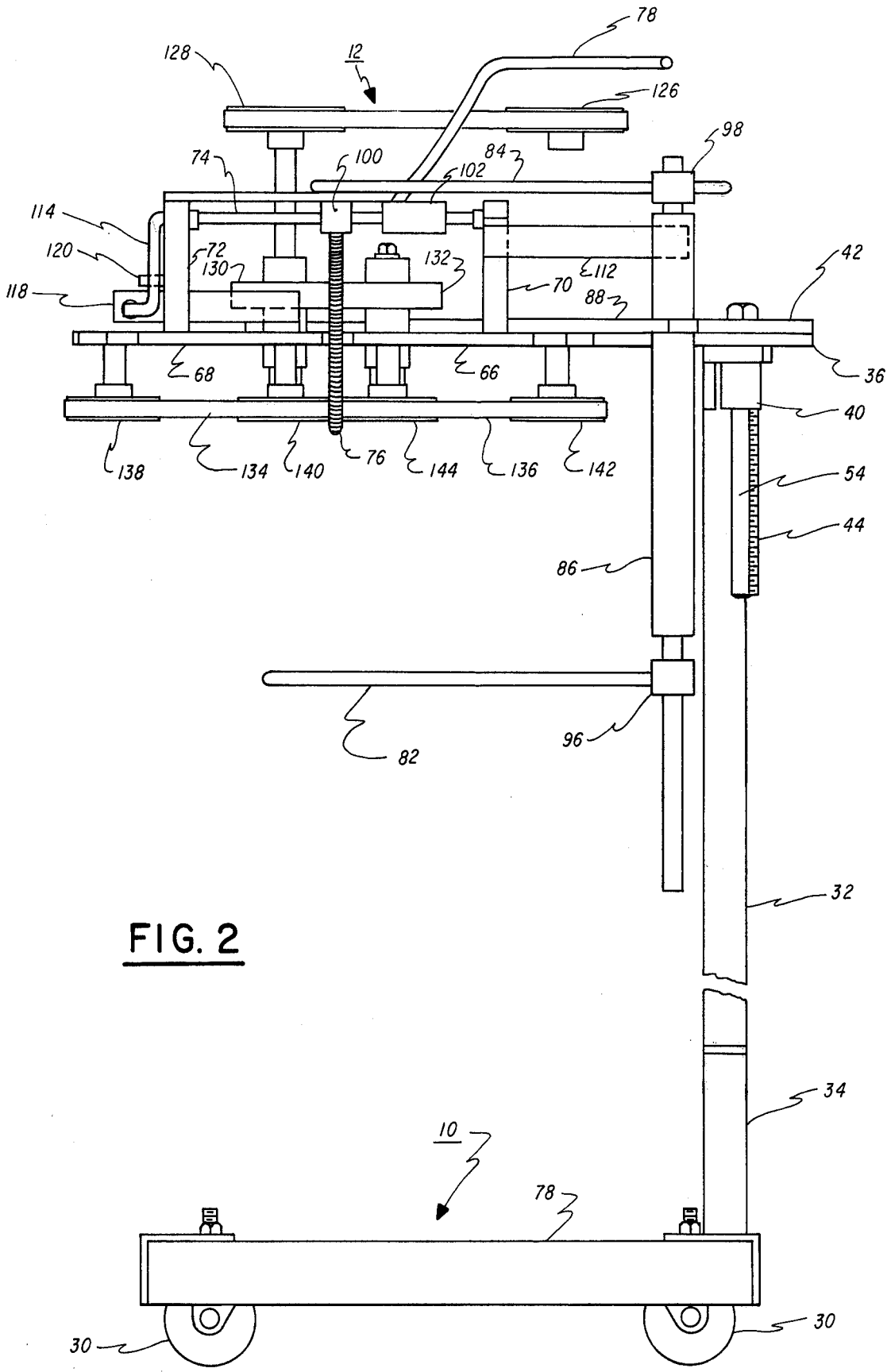
FIG. 2 is a left side view of the machine shown in FIG. 1.
Figure 3:
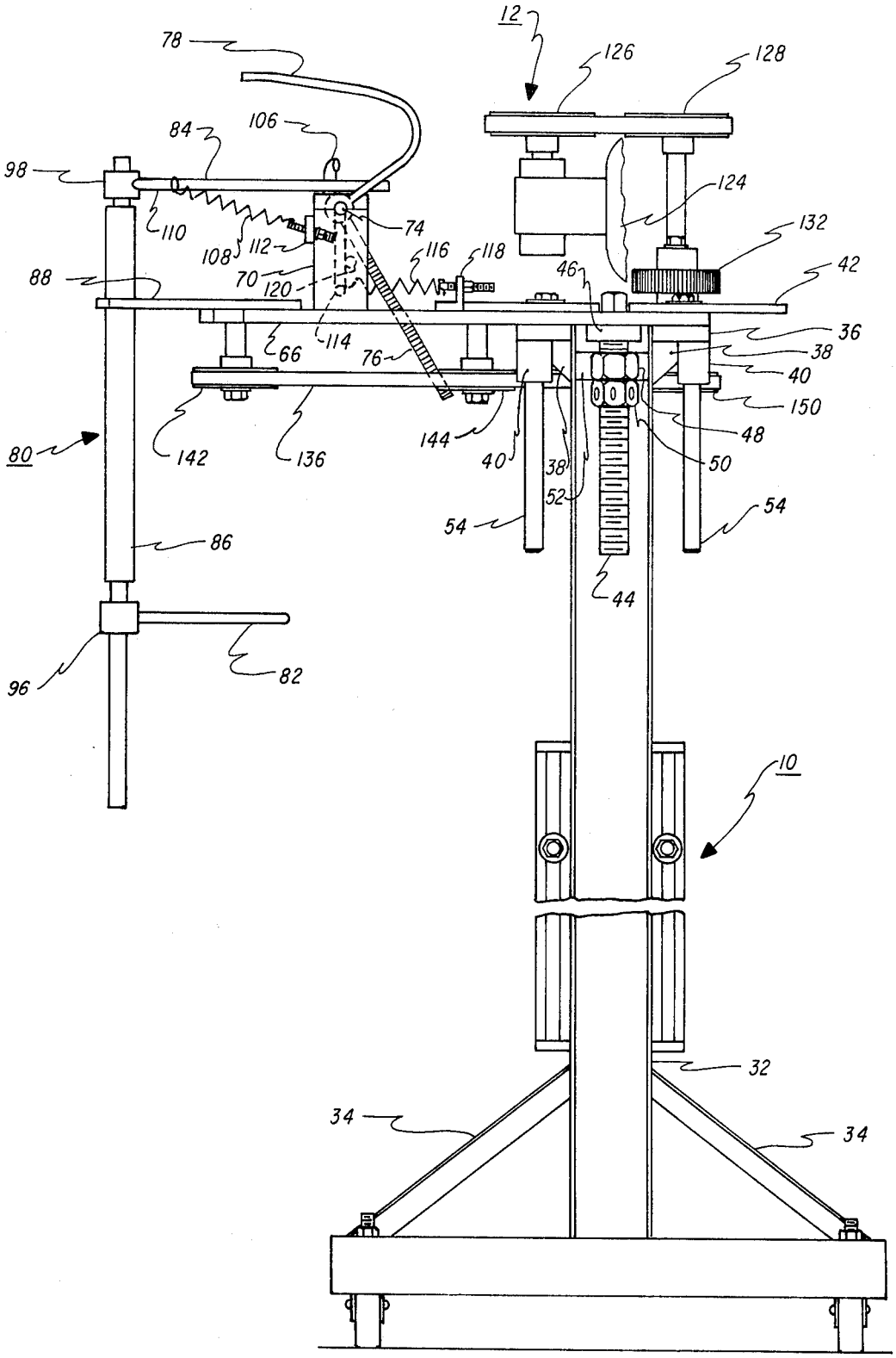
FIG. 3 is a front view of the machine illustrated in FIG. 1.
Figure 4:
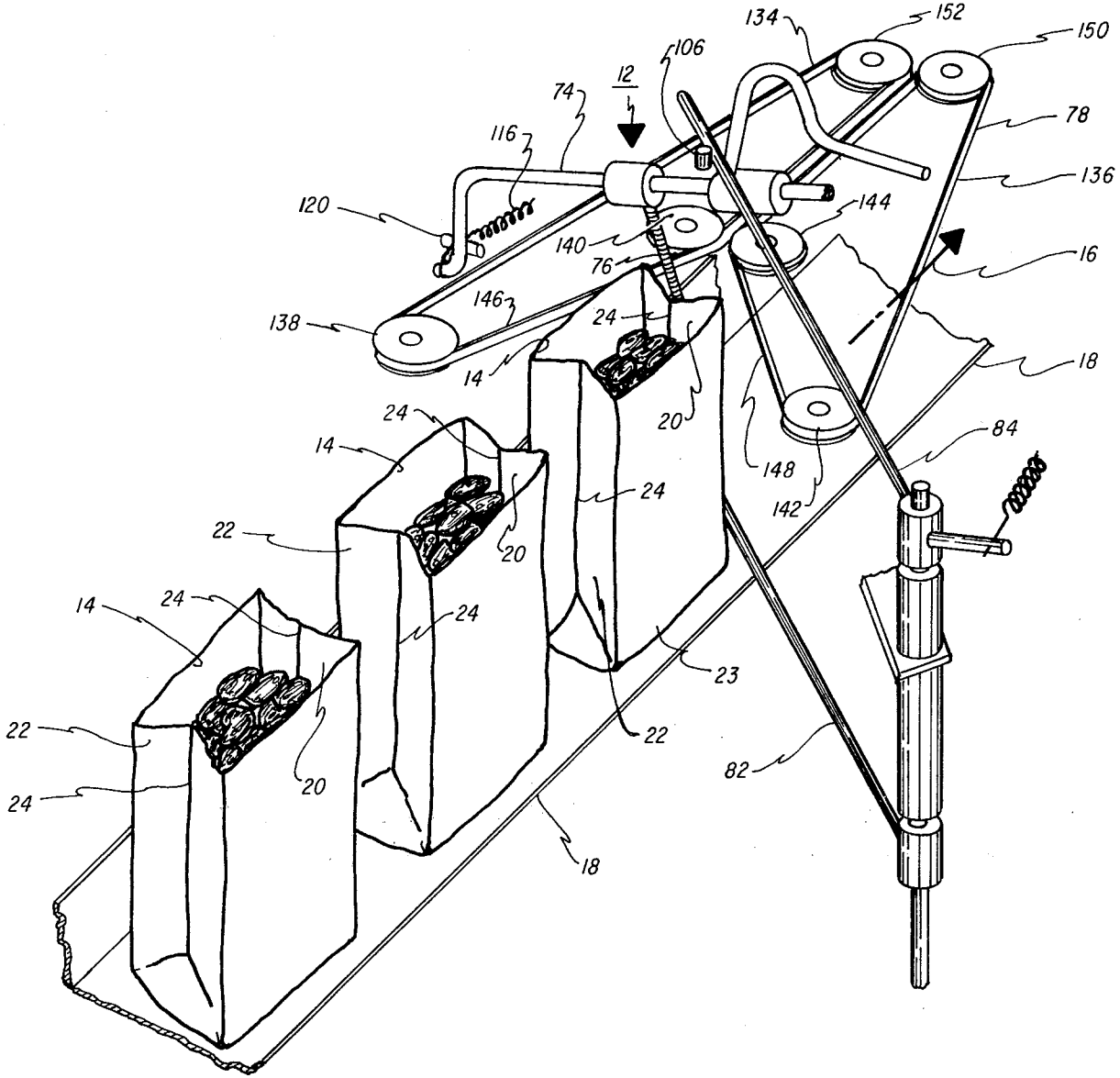
FIGS. 4, 5 and 6 are simplified perspective views of the machine shown in FIGS. 1, 2 and 3 in various successive positions in the course of a bag closing operation.

Referring more particularly to FIGS. 1, 2 and 3, there is shown a carriage assembly 10, on which is mounted an assembly 12 which operates to close successive bags 14. These bags 14 may be paper sacks which are driven along a path of travel 16 as by being carried on a conveyor belt 18 (see also FIGS. 4, 5 and 6). These sacks 14 have leading and trailing sides 20 and 22. Gussets 24 may be preformed in these sides 20 and 22, (see FIG. 4). The sacks 14 are filled before reaching the closing apparatus such that the upper ends of mouths of the bags are open. It is the purpose of the apparatus to fold and close these mouths. The closed bags are then fed into a sealing machine such as a stitcher which stitches the folded and closed mouths of the bags shut.

It will be appreciated that the folding and closing apparatus provided in accordance with the invention may be used to fold and close other containers, such as packages which have portions requiring tucking and/or folding operations in order to close the same.

The carriage assembly 10 has a frame work 28 which is rectangular in shape and which is adapted to be mounted on casters 30. A mast in the form of a C channel 32 is attached to the framework and may have angle irons struts 34 extending from the framework for keeping the mast 32 in upright position.

A mounting plate 36 is affixed to the top of the mast 32 and is secured thereto by brackets 38. Bushings 40 are attached to the underside of the mounting plate 36.

The closing assembly 12 is attached to a support plate 42 which rests on the mounting plate 36. The entire bag closing assembly 12 may be raised or lowered by means of a bolt 44. The upper end of the bolt is formed with a shoulder 46 on which the support plate 42 rests. Two nuts 48 and 50 are provided. One of these nuts 48 is located in a slot 52 in the mast (see FIG. 3). By loosening lower nut 50 and turning the bolts 44, the support plate 42 may be raised or lowered. The lower nut 50 is tightened when the closing assembly 12 is at the desired vertical position. This vertical position will of course depend upon the size of the bag which is to be closed. A pair of rods 54 are attached to the support plate 42 and extend through the bushings 40. These rods provide lateral support against twisting and tilting of the support plate 42 and the entire closing assembly 12.

As shown in FIG. 1, the support plate 42 has three slots 56, 58 and 60. The head of the bolt 44 extends through the center slot 58. These slots permit lateral adjustment (viz., a direction perpendicular to the path of travel 16, widthwise of the conveyor 18). Bolts 62 and 64 which extend from the support plate 42 into the mounting plate 36 are used to lock the support plate 42 in position on the mounting plate after the desired lateral adjustment is made. Such lateral adjustment serves to align the closing mechanism with the bag 14, such that folds are formed in the center of the leading and trailing sides 20 and 22 of the bags 14 at the center thereof (viz., at the gussets 24, see FIGS. 4 to 6).

Attached to the support plate 42 are a pair of outrigger bars 66 and 68. These bars 66 and 68 diverge from each other to form a "V". Riser bars 70 and 72 disposed approximately midway along the length of the outriggers 66 and 68 have a shaft 74 journaled therein. An oscillating finger 76 is attached to the shaft 74 and rotates therewith. This finger is shown a rod of flexible material, such as a tightly wound spring. A rod of rigid material may also be used for the finger 76. This finger oscillates through an arc of approximately 120° from a position as shown in FIG. 3 where the finger will be disposed between the trailing side 22 and the leading side 20 of successive bags (see FIG. 4) to a position where the finger 76 is approximately horizontal and thus is above the open mouth of the bags. The finger 76 is shown approaching this horizontal position in FIG. 5.

This arc of approximately 120° described by the finger 76 as it oscillates is determined by a mechanism for driving the shaft 74. This mechanism is provided by a curved rod which forms a cam 78. The cam 78 is attached to and rotates with the shaft. The cam is driven by an actuator mechanism 80. A sensor bar 82 and a cam actuator bar 84 which are rotatably mounted by being attached to a shaft 86 provide the actuator mechanism 80. The shaft 86 is mounted on a plate 88 such that it is spaced laterally away from the conveyor 18. The shaft 80 is journaled in the plate 88. The position of the shaft 86, both in the direction along the path of travel 16 and in the direction perpendicular thereto (laterally) may be adjusted by means of a slot 90 in the plate 88 and a bolt 92. The bolt 92 extends through the slot and fastens the plate 88 to the outrigger 66.

The position of the actuator mechanism 80 may be adjusted again to accommodate different sizes of bags 14. Also the angle between the sensor bar 82 and the cam actuator bar 84 may be adjusted by collars 96 and 98 which are provided for attaching the bars 82 and 84 to the shaft 86 and may be used for providing the adjustment. Set screws (not shown) may be used to fix the collars 96 and 98 to the shaft 86 at the desired angular position. It will be noted that the finger 76 and the cam 78 are also attached to the shaft 74 by means of collars 100 and 102 which provide means for adjusting the relative angular position of the finger 76 and the cam 78 on the shaft 74.

A bar 104 which is attached at one end to the riser bar 72 carries a stop 106 for the cam actuator bar. The actuator mechanism 80 is biased in a counter-clockwise direction, as viewed in FIG. 1, by means of a spring 108. The spring is attached between a stub 110 and a bar 112. The bar 112 is attached to the riser 70 and the stub 110 is attached to the shaft 86 by being secured to the collar 98 which in turn is attached to the shaft 86. The cam actuator bar 84 is thus normally biased against the stop 106.

One end of the shaft 74 extends radially from the shaft to form a crank 114. A spring 116 is connected between the end of the crank 114 and a bracket 118. The bracket 118 is attached to the support plate 42. A stub 120 limits the rotation of the shaft by engaging the crank 114.

The sensor bar 82 is engaged by the leading side 20 of each bag 14, thus causing the cam actuator bar 84 to rotate in a clockwise direction against the bias of the spring 108. The cam 78 is driven to rotate the shaft against the bias of the spring 116. The finger 76 is then driven in a clockwise direction as viewed in FIG. 3 and executes its forward stroke of oscillation. The rotation of the shaft and thus the timing of the rotation of the finger is a function of the position of the bag 14. The finger 76 describes an arc of oscillation which intersects the leading side of the bag, thus tucking in and forming a fold therein at the gusset 24 (see FIG. 4). It will be noted that the conveyor 18 may also include a vertically disposed belt which supports the rear walls of the bags. Pressure rollers, not shown, may urge the bags against the vertical conveyor belt.

Figure 5:
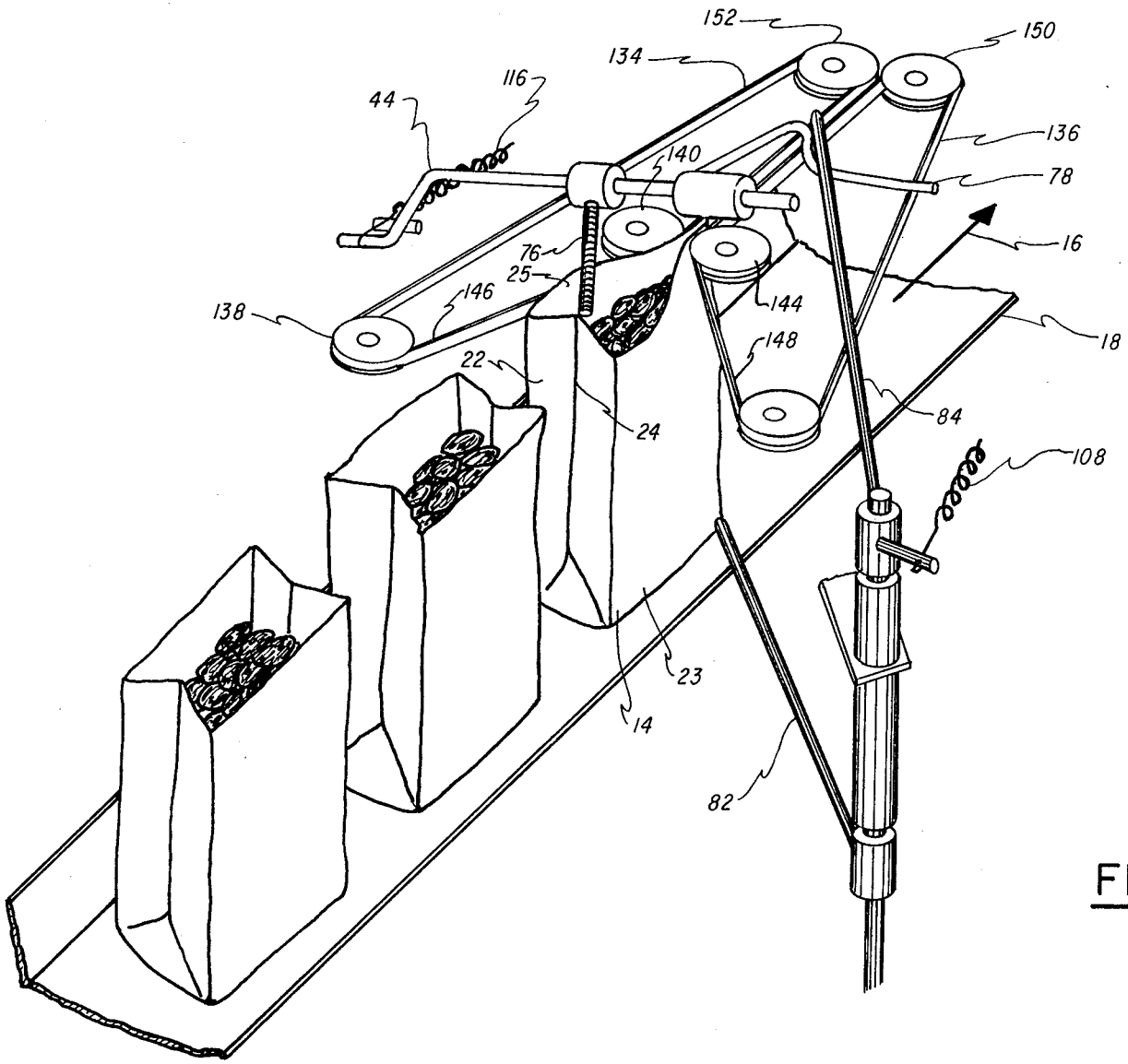

As the bag travels along the conveyor 18 the sensor arm 82 rides over the front wall 23 of the bag, thus moving the finger upwards to its vertical position above the top of the bag 14 (see FIG. 5). So long as the sensor arm 82 remains in contact with the front wall 23 of the bag, the finger 76 remains in the horizontal position (viz., at the end of its forward stroke of oscillation). The bias provided by the spring 108 maintains the sensor bar biased against the front wall 23 of the bag 14. The cam actuator bar remains on the outer portion 122 of the cam and restrains the motion of the cam, the shaft 74 and the finger 76 notwithstanding the bias of the spring 116.

Figure 6:
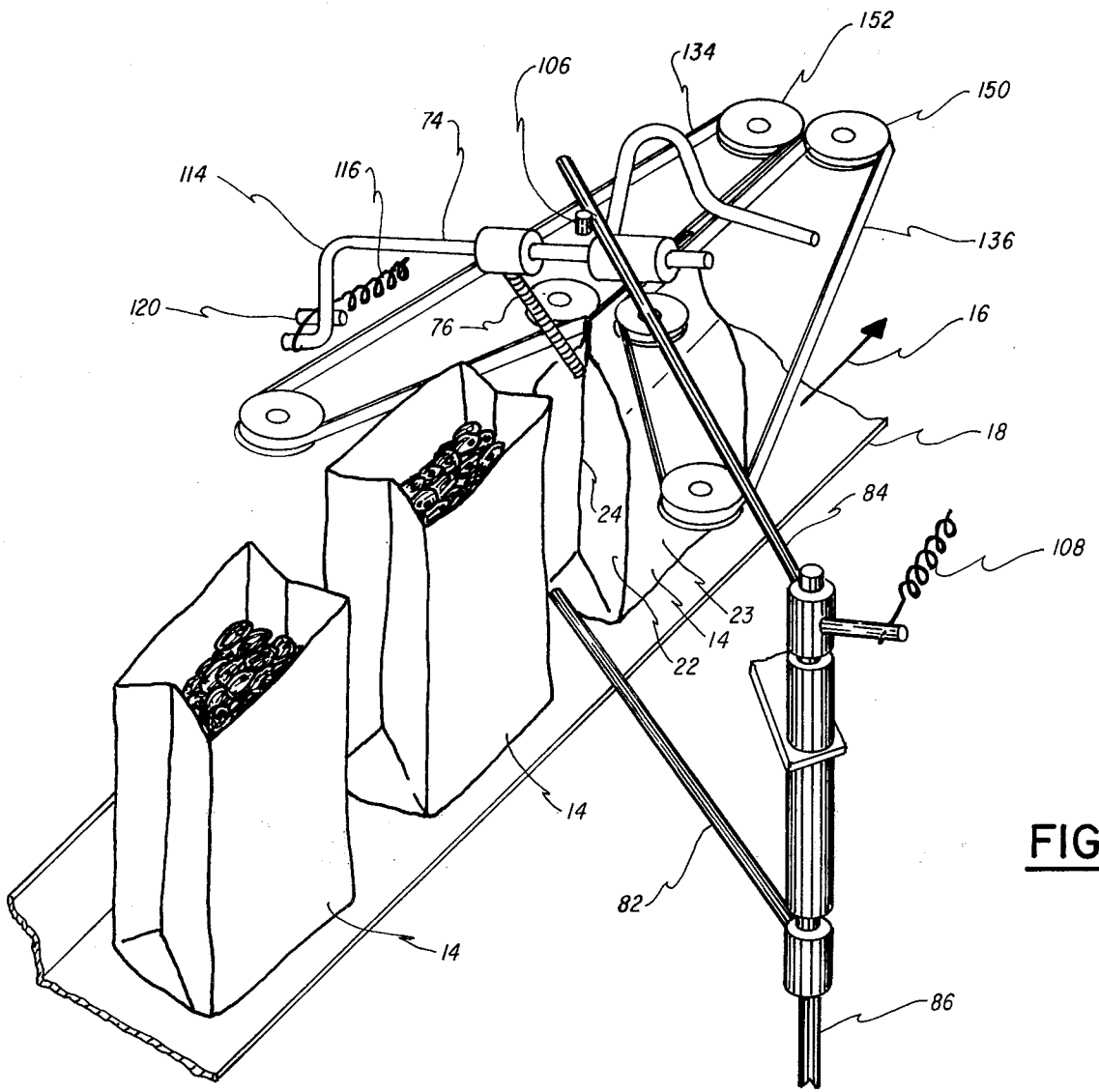

When the sensor arm 82 drops off the front wall 23 of the bag 14, the shaft 86 rotates under the bias of the spring 108 and quickly returns to the position where the cam actuator bar 84 reaches the stop 106 (see FIG. 6). Rotation of the shaft 74 under the bias of the spring 116 is thus enabled and the finger 74 executes its return stroke. The bag 14 is then positioned so that its trailing edge 22 intersects the arc described by the finger 76. The finger thus engages the trailing side wall 22 at the gusset 24 and folds in the upper portion of the open end of the bag 14. The finger 76 is now back in the position between the trailing side and leading side of successive bags 14 on the conveyor 18 and is ready to fold in the side walls of the succeeding bag (see FIG. 6).

Also mounted on the support plate 42 is a gear motor 124. This gear motor drives a pulley 126. The pulley is belted to a drive pulley 128 and serves to drive a pair of gears 130 and 132. Attached to the same shaft as these gears 130 and 132 are drive pulleys for driving belts 134 and 136. Each of these belts 134 and 136 is entrained around a system of three pulleys. Two of these pulleys 138 and 140, in the case of the belt 134, and two of these pulleys 142 and 144, in the case of the belt 136, provide reaches 146 and 148 of the belts 134 and 136 which define a V. The other pulleys 150 and 152 drive the belts 134 and 136 respectively.

As shown in FIG. 5 the folded leading side of the bag 14 enters the reaches 146 and 148 of the belt between the pulleys 140 and 144, immediately after finger 76 has formed the fold therein. The belts 134 and 136 press the upper portion of the folded bag together; the belt 136 bearing on the front wall of the bag while the belt 134 bears on the rear wall 25 of the bag 14. The belts are driven by the motor 124 through the gearing and pulleys such that the speed of the belts is the same as the speed of the conveyor 18. There is therefore little if any significant slippage on the conveyor due to the closing action provided by the belts 136.

As shown in FIG. 6, just before the trailing side of the bag enters the belts, the finger 76 will execute its return stroke so as to form the fold in the trailing side of the bag. The belts proceed to close the bag along the fold and presents the closed bag to the sealing device which, as mentioned above, may be a stitching machine.

From the foregoing description it will be apparent that there has been provided an improved apparatus for closing containers. While a preferred embodiment of the invention which is adapted to close the open ends of filled bags, has been described, it will be appreciated that variations and modifications thereof and also applications of the invention in connection with the closing of other packages and container types will of course suggest themselves to those skilled in the art. Accordingly, the foregoing description should be taken as illustrative and not in any limiting sense.

It is claimed:

1. For use in closing open ends of containers while they move along a path of travel with the trailing and leading sides of successive containers spaced from each other, apparatus which comprises a finger disposed adjacent to said path of travel and rotatably mounted to oscillate along an arc between a first location between said trailing and leading sides of said successive containers and a second location spaced from an open end thereof, and means responsive to the movement of each of said successive containers along said path of travel and actuated by said containers as said containers move along said path past the vicinity of said finger for causing said finger to oscillate from said first location to said second location and then from said second location to said first location so as to form inward folds in the leading and trailing sides of each of said containers at the open end thereof, said actuation by said containers being provided by a mechanism comprising a rotatable first bar having an end which successively pivots from a position into engagement with said containers to a position into the space between the trailing and leading sides of successive ones of said containers, a second bar rotatable with said first arm, a cam member disposed in engagement with said second bar, said cam member and said finger being rotatably mounted for conjoint movement, said second bar providing for displacement of said cam member, said cam member having a shape such that the displacement of said finger along said arc from said first position to said second position is a function of the displacement of said container along said path of travel and said container is disposed in a position with its trailing side intersecting the arc of said finger when said finger reaches said second position.

2. The invention as set forth in claim 1 wherein said mechanism includes means for biasing said cam into its engagement with said second arm, said bias also being in a direction to return said finger to its said first position when said second arm releases said cam as said containers move out of engagement with said first bar end and said first bar end rotates to bring said first bar end into the space between successive ones of said containers.

3. The invention as set forth in claim 2 wherein said biasing means is a spring in driving relationship with said finger and cam.

4. The invention as set forth in claim 3 wherein said mechanism further includes spring means in driving relationship with said first bar for biasing said first arm towards said containers.

5. Apparatus for folding the mouth of a bag which is adapted to travel along a path, said apparatus comprising a. a folding element for forming a fold in the leading and trailing sides of said bag, b. a first shaft to which said folding element is attached, said first shaft being disposed above said path, c. said folding element extending downwardly from said shaft to a first position in the path of the upper portion of the leading side of said bag, d. a cam member attached to said shaft and rotatable therewith, e. a cam actuator member engaging said cam member for rotating said first shaft to pivot said folding element into the upper portion of said leading side of said bag to form the fold therein and to displace said folding element to a second position above the mouth of said bag, f. a second shaft, g. said cam actuator member being attached to said second shaft for rotation therewith, and h. actuating means for rotating said second shaft and said cam actuator so as to displace said folding element to said second position, and enabling said folding element to pivot into the upper portion of the trailing side of said bag to form the fold therein and to return to said first position.

6. The invention as set forth in claim 5 wherein said actuating means is actuated by said bag.

7. The invention as set forth in claim 6 wherein said actuating means includes an actuator bar attached to said second shaft and engageable with said bag, said actuator bar rotating said second shaft and said cam actuator therewith while said bag travels along said path.

8. The invention as set forth in claim 7 wherein said actuating means also includes, means for biasing said folding element toward said first position, said biasing means being operative to return said folding element to said first position thereby forming said trailing edge fold when said bag moves out of engagement with said actuator arm.

9. The invention as set forth in claim 5 wherein said second shaft is disposed laterally away from said path of travel and said cam member also extends laterally away from said path of travel.

10. The invention as set forth in claim 9 further comprising a pair of belts coming together from opposite sides of said path of travel to define a "V", said belts being engageable with said bag on opposite sides of said folds to press said folds inwardly and close the mouth of said bag.

* * * * *